US005239343A

United States Patent [19]

Sakemi et al.

[11] Patent Number: 5,239,343

[45] Date of Patent: Aug. 24, 1993

[54] DEVELOPING APPARATUS WITH REGULATING MEMBER HAVING MAGNETIC AND NON-MAGNETIC MEMBERS

[75] Inventors: Yuji Sakemi, Yokohama; Hatsuo Tajima, Matsudo; Kenji Okado; Masahiro Inoue, both of Yokohama, all of Japan

[73] Assignee: Canon Kabushiki Kaisha, Tokyo, Japan

[21] Appl. No.: 660,152

[22] Filed: Feb. 20, 1991

Related U.S. Application Data

[63] Continuation of Ser. No. 238,595, Aug. 31, 1988, abandoned.

[30] Foreign Application Priority Data

Aug. 31, 1987 [JP] Japan ..... 62-218241

[51] Int. Cl.[5] ..... G03G 15/08

[52] U.S. Cl. ..... 355/253; 118/658

[58] Field of Search ..... 118/658, 653, 656; 355/251, 253, 245

[56] References Cited

U.S. PATENT DOCUMENTS

| | | | |
|---|---|---|---|
| 4,233,935 | 11/1980 | Uehara et al. | 118/658 X |
| 4,244,322 | 1/1981 | Nomura et al. | 118/658 |
| 4,451,134 | 5/1984 | Fukuchi et al. | 118/658 X |
| 4,517,274 | 5/1985 | Honda et al. | 118/658 X |
| 4,637,706 | 1/1987 | Hosoi et al. | 118/658 X |
| 4,672,017 | 6/1987 | Kamezaki | 118/658 X |
| 4,777,107 | 10/1988 | Kurematsu et al. | 118/658 X |
| 4,916,492 | 4/1990 | Hoshika et al. | 355/253 |

*Primary Examiner*—A. T. Grimley
*Assistant Examiner*—Robert Beatty
*Attorney, Agent, or Firm*—Fitzpatrick, Cella, Harper & Scinto

[57] ABSTRACT

A developing apparatus includes a developer layer thickness regulating zone downstream of one of magnetic poles of a stationary magnet disposed inside a developing sleeve, with respect to the rotational direction of the sleeve. In the regulating zone, there are provided a magnetic member and a non-magnetic member to regulate the layer thickness of the developer containing magnetic carrier particles and toner particles on the sleeve. The magnetic member has a width of not less than 1 mm and not more than 10 mm and a thickness of not less than 0.2 mm and not more than 3 mm.

30 Claims, 6 Drawing Sheets

DEVELOPING APPARATUS WITH REGULATING MEMBER HAVING MAGNETIC AND NON-MAGNETIC MEMBERS

This application is a continuation of application Ser. No. 238,595, filed Aug. 31, 1988, now abandoned.

FIELD OF THE INVENTION AND RELATED

The present invention relates to a developing apparatus for developing an electrostatic latent image.

A type of developing apparatus is known wherein a thin layer of magnetic developer is carried on a developing sleeve made of non-magnetic material enclosing a magnet and is supplied to an electrophotographic photosensitive member to develop an electrostatic latent image formed thereon. As a means for forming the thin layer of the magnetic developer, there is known a magnetic blade. Typical magnetic blades of this type are disclosed in Japanese Patent Application Publication 8831/1984, U.S. Pat. Nos. 4,387,664, 4,391,512 and 4,511,239, in which a free end of a magnetic blade is disposed opposed to a stationary magnetic field generating magnet. Using this technique, Japanese Laid-Open Patent Application Nos. 29062/1982 and 138860/1987 disclose that a non-magnetic blade is disposed immediately downstream of the magnetic blade to prevent clogging of the magnetic developer. That technique is characterized in that a very strong concentrated magnetic field is formed at the free end of the magnetic blade.

In order to form the concentrated magnetic field at the end of the magnetic blade opposed to the magnetic pole, it is required that the length of the blade, measured in the direction away from the sleeve, is quite long to maintain a volume.

SUMMARY OF THE INVENTION

It is a principal object of the present invention to provide a developing apparatus wherein a layer of a developer containing magnetic carrier particles is regulated in thickness, using a magnetic member and a non-magnetic member.

When the magnetic field is strongly concentrated to the end of the magnetic member adjacent to the developer carrying member, a very high density, and therefore, hard magnetic brush layer is formed, by which the friction between the toner and carrier particles triboelectrically charge the toner to an excessive extent. Then, the toner is deteriorated by the stress given by the carrier particles. Therefore, the image density tends to gradually decrease. In addition, the toner receives a strong charge force to such an extent that it functions as a binder for the carrier particles, resulting sometimes formation of blocks of the developer. These may clog the regulating clearance formed between the regulating blade and the developer carrying member to form stripes in the developer layer, resulting in the stripes in the developed image.

According to the present invention, the density of the developer in the magnetic field at the regulating portion is decreased, so that the stress given by the carrier to the toner is decreased. Therefore, in the present invention, the magnetic field is not strongly concentrated locally, but rather, the portion where the magnetic field is concentrated is enlarged, by which the inconveniences described above are eliminated.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
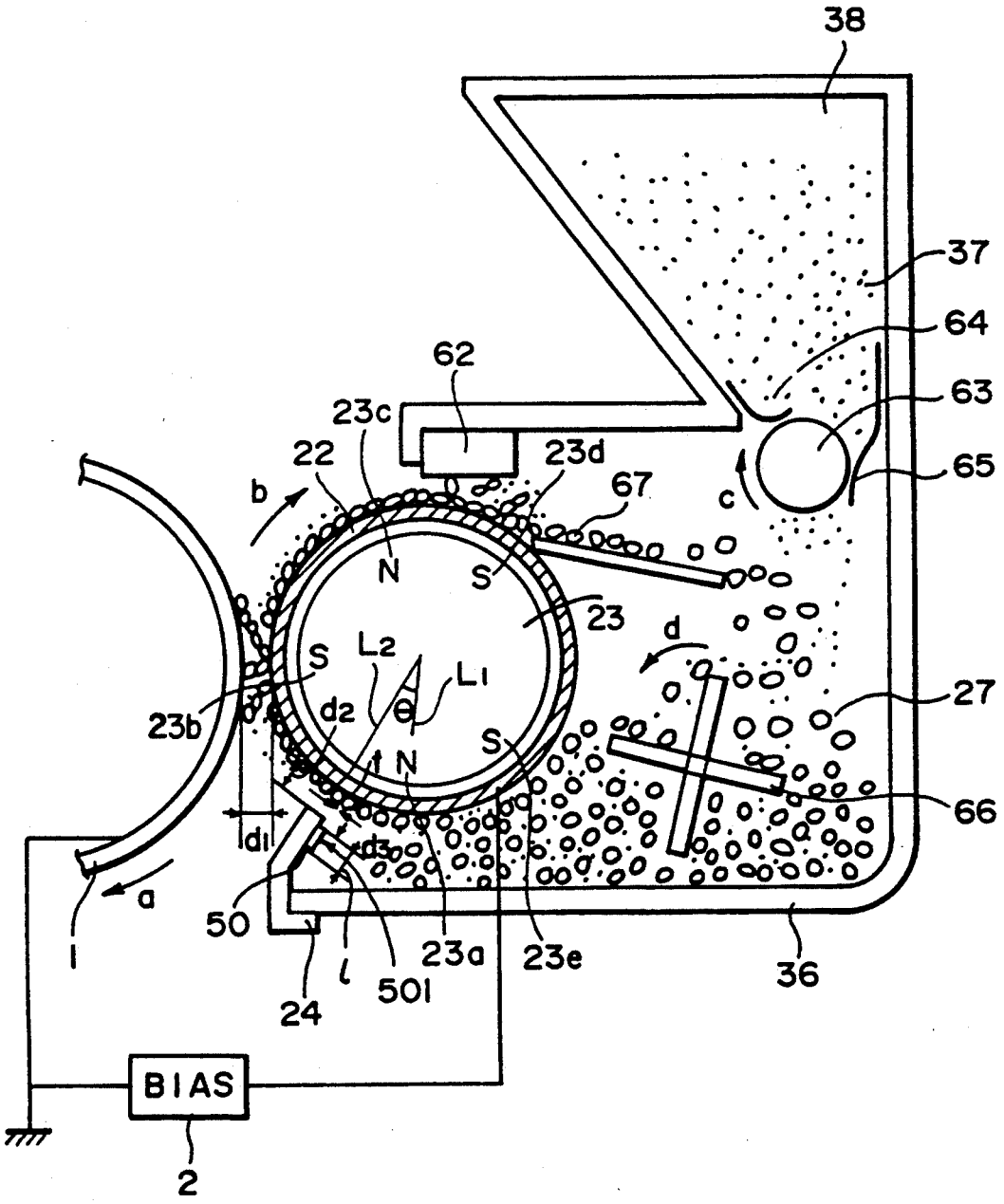
FIG. 1 is a cross-sectional view of a developing apparatus according to an embodiment of the present invention.

Referring to FIG. 1, there is shown a cross-sectional view of a developing apparatus according to an embodiment of the present invention. In this Figure, an electrostatic latent image bearing member is designated by a reference 1 and is in the form of an insulating drum for electrostatic recording, or a photosensitive drum or belt having a photoconductive insulative layer such as A-Se, CdS, $ZnO_2$, OPC (organic photoconductor) or A-Si. The latent image bearing member 1 is driven in a direction indicated by an arrow a by an unshown driving device. On the latent image bearing member 1, an electrostatic latent image is formed through a process known in the field of electrostatic recording or electrophotography. Adjacent to or in contact with the latent image bearing member 1, a cylindrical developing sleeve 22 is disposed and is made of a non-magnetic material such as aluminum or stainless steel, SUS 316 (JIS), for example. A developer container 36 is provided with an elongated opening extending in the direction of the length of the container in its lower left wall in the Figure. About one half of the circumference of the developing sleeve 22 at the right side in the Figure is in the container 36, and the remaining left half is exposed outside the container. The developing sleeve 22 is rotatably supported for rotation in the direction indicated by an arrow b.

A stationary magnetic field generating means in the form of a stationary permanent magnet is within the developing sleeve 22 and is fixed at a position shown in the Figure, and the position and the pose or orientation of the magnet 23 is maintained even if the developing sleeve 22 is rotated. The magnet 23 has an N pole **23*a* for producing a magnetic field effective to regulate the thickness of a layer of the developer, S pole 23*b* for producing development magnetic field, N pole 23*c*, S pole 23*d* and S pole 23*e*. The magnet 23 may be in the form of a permanent magnet or in the form of an electromagnet. The maximum of a radial component of the magnetic flux density at the sleeve surface provided by the magnet 23 is approximately 700 Gausses at the magnetic pole 23***a* and at the magnetic pole 23*c;* 850 Gausses at the magnetic pole 23*b;* and approximately 600 Gausses at the magnetic pole 23*d* and the magnetic pole 23*e*.

The magnetic pole 23*a* is disposed upstream of a magnetic blade 50 which will be described hereinafter, with respect to the rotational direction of the sleeve 22, that is, the developer movement direction, and is disposed so that an angle $\theta$ of 20 degrees is formed between a non-magnetic blade 24 which will be described hereinafter.

The non-magnetic blade 24 has a base portion fixed to the wall of the container adjacent to a lower end of the opening of the developer supply container in which the developing sleeve 2 is disposed. A free end of the non-magnetic blade 24 is extended along and adjacent to the sleeve 22 to function as a developer regulating member. The non-magnetic blade 24 is made of, for example, stainless steel SUS 316 (JIS) bent into the form indicated in the Figure. A magnetic blade 50 is made of iron, and it functions to assist the regulation of the developer layer thickness by the non-magnetic blade 24. The magnetic blade 50 is bonded to a side of the non-magnetic blade 24. The magnetic blade 50 has a surface 501 which is adjacent to the magnetic field generating portion 23*a* and onto which the magnetic field is concentrated. The length (width) 1 of the surface 501 measured in the direction away from the developer carrying member 22 is 6 mm.

Each of the magnetic particles 27 functioning as carrier particles, may include a ferrite particle (maximum saturation magnetization is 30–100 emu/g) having a particle size of 20–100 microns, preferably 30–80 microns and having a resistivity of not less than $10^7$ ohm.cm and not more than $10^{13}$ ohm.cm, preferably not less than $10^8$ ohm.cm and not more than b $10^{12}$ ohm.cm, and including a resin coating of very thin fluorine, acrylic resin for the purpose of charge control of the toner. Since the coating is very thin, it does not substantially change the particle size of the resistivity of the ferrite particle.

Another material such as iron or cobalt is usable if the particle size, the resistivity and the saturated magnetization are within those ranges described.

Designated by a reference numeral 37 is a non-magnetic toner. The sleeve 22 carries the two component developer containing the carrier particles 27 and the toner particles 37 mixed together.

A toner content detecting sensor 62 serves to detect the toner component in the developer, and in response to an output of the sensor 62, a toner supplying roller 63 is rotated in the direction indicated by an arrow c and is stopped, repeatedly to properly supply the toner particles. Sealing members 64 and 65 are provided to regulate the application of the toner particles on the toner supplying roller 63.

A stirring member 66 rotatably in the direction indicated by an arrow d functions to mix and stir the supplied toner and the developer scraped off the sleeve 22 by the scraper 67.

Designated by a reference numeral 38 is a toner container.

The description will be made as to the mechanism of forming a developer layer. The developer layer regulating region defined by the non-magnetic blade 24, the magnetic blade 50 and the magnetic pole 23*a* constitute a field or zone wherein the magnetic developer is confined and regulated by the magnetic field. The surface of the magnetic blade 501 having the width 1 is effective to concentrate thereon the magnetic lines of flux from the upstream magnetic pole 23*a*, but it should be noted that the magnetic lines of flux are not mainly on the blade edge opposed to the sleeve 22, but they are mainly concentrated on and uniformly distributed on the entire surface 501. Therefore, the magnetic lines of flux are not pointed but are spread along the width 1. The magnetic field concentrated in this manner forms a relatively sparse magnetic brush, in other words, a relatively soft magnetic brush is formed in the regulating region or zone. The concentrated magnetic field formed to the magnetic blade 50 confines the amount of developer passing by the magnetic blade 50 on the sleeve 22, and an excessive amount of the developer having passed by the magnetic blade 50 is blocked by the next, non-magnetic blade 24. The non-magnetic blade 24 functions to confine the amount of the passing developer and to function to make the thickness of the developer layer more uniform. The concentrated magnetic field relatively uniformly distributed over the surface 501 of the magnetic blade is effective to establish the relatively soft magnetic brush of the developer, and therefore, the extreme triboelectric charging or deterioration of the toner by strong load is prevented, and the developer is prevented from coagulating and from clogging in the regulating zone. Accordingly, a thin and uniform thickness developer layer is stably formed for a long period of time. The developer layer thus regulated is conveyed to the developing station. The developer layer is contacted to the photosensitive member in the developing zone.

A developing bias source 2 applies to the sleeve 22 an alternating voltage, an alternating voltage superposed with a DC voltage or a pulse voltage, so as to form a vibrating electric field in the developing zone where the sleeve 22 and the photosensitive drum 1 are opposed. By the vibrating electric field, the toner and carrier particles vibrate, so that the toner particles deposited on the carrier particles and the sleeve surface are efficiently used for the developing action and deposited to image portions of the electrostatic latent image for visualization.

The toner content of the developer after development is detected by the toner content detecting sensor 62. If the toner content is low, the supplying roller 63 is rotated to supply the toner.

In this embodiment of the present invention, the developer layer is stabilized by the above-described regulation, and therefore, the following conditions in the developing zone are stabilized, and good developing operation can be maintained stably and for a long period of time.

The description will be made with respect to a volumetric ratio of the magnetic particles at the developing zone. The "developing zone" or "developing portion" is defined as the region in which the toner particles are transferred or supplied from the sleeve 22 to the photosensitive drum 1. The "volumetric ratio" is the percentage of the volume occupied by the magnetic particles present in the developing zone to the entire volume of the developing zone. The volumetric ratio is significantly influential in this developing apparatus, and it is preferable that the volumetric ratio is 1.5–30%, further preferably 9–26%.

If this is smaller than 1.5%, the image density of the developed image is too low; a ghost image appears in the developed image; a remarkable density difference results between the position where the chains of the magnetic brush exist on the sleeve 22 surface and the position where no chain exists; and/or the thickness of the developer layer formed on the sleeve 22 is not uniform.

If the volumetric ratio is larger than 30%, the surface of the sleeve 22 is closed by the chains of the magnetic brush, that is, covered by the magnetic particles too much, and a foggy background results; and/or the fluidability of the developer changes under a high humidity condition with the result that the developer overflows from the developing device.

The volumetric ratio of the magnetic particles in the developing zone is determined by;

$$(M/h)\times(1/\rho)\times[C/(T+C)]$$

where M is the weight of the developer (the mixture) unit area of the sleeve surface when the erected chain are not formed ($g/cm^2$);

h is the height of the space of the developing zone (cm);

$\rho$ is the true density ($g/cm^3$);

C/(T+C) is the percentage by weight of the magnetic particles in the developer on the sleeve.

The percentage of the toner particles to the magnetic particles at the developing position as defined above is preferably 4–40% by weight. When the vibrating magnetic field is strong as in this embodiment (the rate of chains or Vpp is large), the chains are released from the sleeve 22 surface or from their base portions, and the released magnetic particles 27 reciprocate between the sleeve 22 and the photosensitive drum 1. Since the energy of the reciprocal movement of the magnetic particles is large, the above-described effects of the vibration are further enhanced.

The regulating zone which is important in this embodiment will be further described.

The distance d2 between the end of the non-magnetic blade and the sleeve 22 surface is preferably not less than about 500 microns, and further preferably not less than 600 microns as a result of various experiments, in order to prevent occurrence of white stripes which is caused by clogging of the coagulated developer particles in the regulating zone. If it is lower, the developer particles are coagulated in the regulating zone with the result of white stripes in the developed image when the images are formed for a long period of time under special conditions. On the other hand, from the standpoint of the electrode effect of the magnetic carrier particles in the developing zone, the minimum clearance d1 between the sleeve 22 and the photosensitive member 1 is preferably not more than 600 microns. As will be understood, those are contradictory to each other, since if the regulating clearance is increased when the regulating zone has only the non-magnetic blade, the developer can be easily passed including the coagulated developer. Then, unexpected large amount of the developer is supplied to the developing zone, with the result that the developing operation can not be performed properly, and/or that the photosensitive member is damaged. However, the developing clearance can not be freely increased.

According to this embodiment of the present invention, the magnetic field in the developer regulating zone is uniformly distributed in the manner described above, the amounts of the magnetic developer and the carrier which are allowed to pass are stabilized, and the production of coagulated developer is decreased, so that the clearance d2 between the non-magnetic blade and the sleeve 22 can be set larger than the developing clearance d1. A distance d3 between the magnetic member and the sleeve is not less than d2 to stabilize the passage of the developer. It is preferable that the distance d2 is not more than 1 mm in order to prevent introduction of excessive developer to the developing zone to form a proper thin layer of developer in the developing zone.

Figure 2:
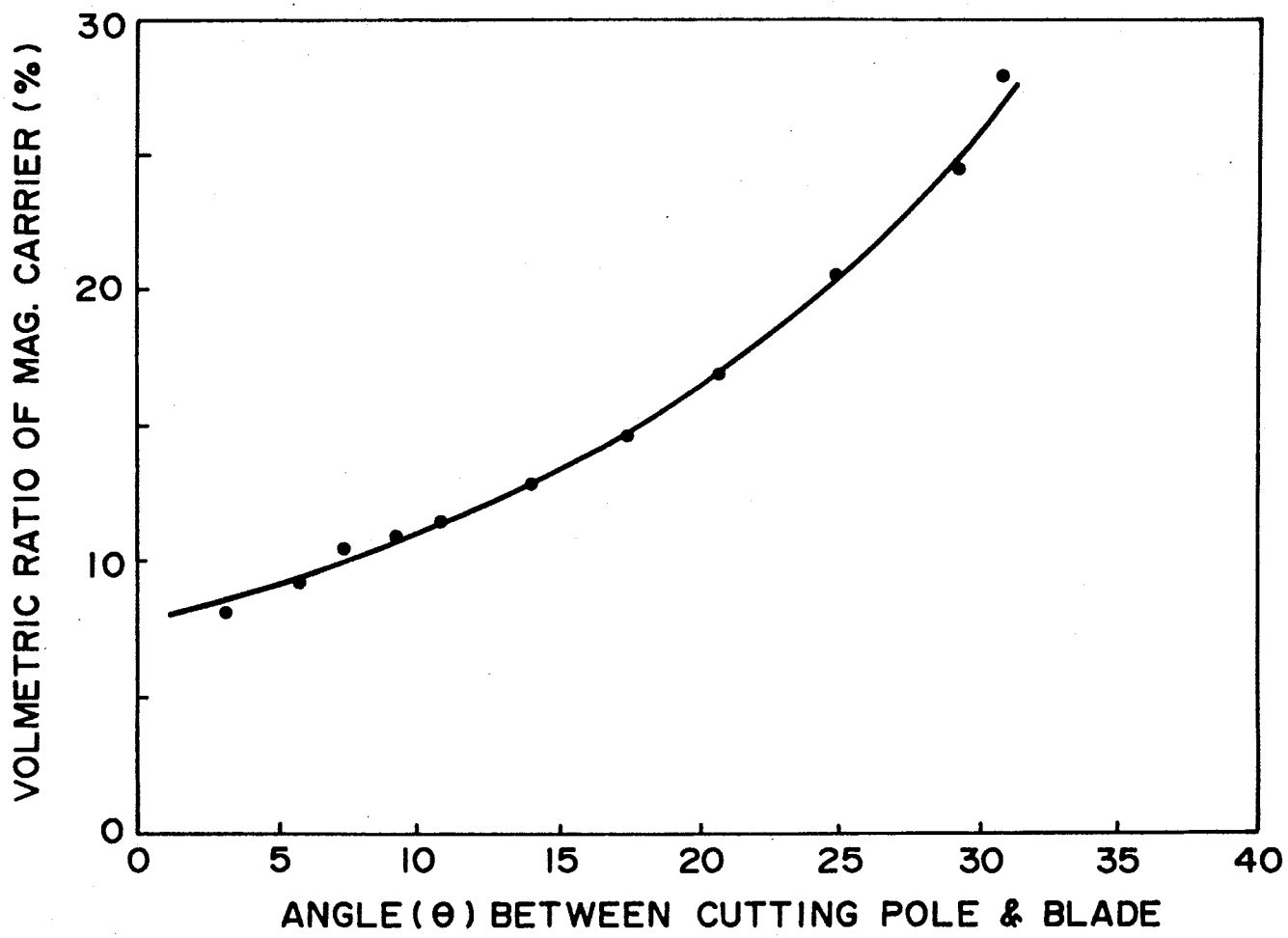
FIG. 2 is a graph of volumetric ratio of the magnetic carrier (%) vs. angle formed between a cutting pole and the blade relative to a center of a developer carrying member.

FIG. 2 shows a relationship between the volumetric ratio of the magnetic particles and the angle $\theta$ formed between the regulating magnetic pole 23a and the non-magnetic regulating blade 24. Here, the clearance d1 between the sleeve 22 and the photosensitive member 1 is 450 microns. The clearance d2 between the non-magnetic blade 24 and the sleeve 22 is 600 microns, and the clearance d3 between the magnetic blade 50 and the sleeve 22 is 900 microns. The magnetic blade 50 has a width 1 of 4 mm and a thickness t of 0.5 mm and is bonded to a side surface of the non-magnetic blade 24.

It is understood from this Figure that the angle $\theta$ is not less than 5 degrees and not more than 30 degrees in order to provide the preferable volumetric ratio of the magnetic particles, not less than 9% and not more than 26%. Even if the dimensions d2, d3, 1 and t are changed, the angle $\theta$ is still preferably not less than 5 degrees and not more than 30 degrees to provide stabilized formation of the developer layer. It is not preferable that the distance d3 between the end of the magnetic member 50 and the surface of the sleeve 22 is larger than 1.5 mm. In order to increase the clearance d3 so as to be larger than 1.5 mm under the condition that the thickness of the developer layer is made substantially constant, a very strong concentrated electric field has to be provided, with the result that the developer is easily clogged in the regulating zone. In addition, the developer is easily deteriorated so that a sufficient image density can not be provided even if the toner content in the developer is proper. Particularly, if the structure is such that the image density decreases down to approximately 80% of the initial density, it is difficult to provide a highly fine image.

Figure 3:
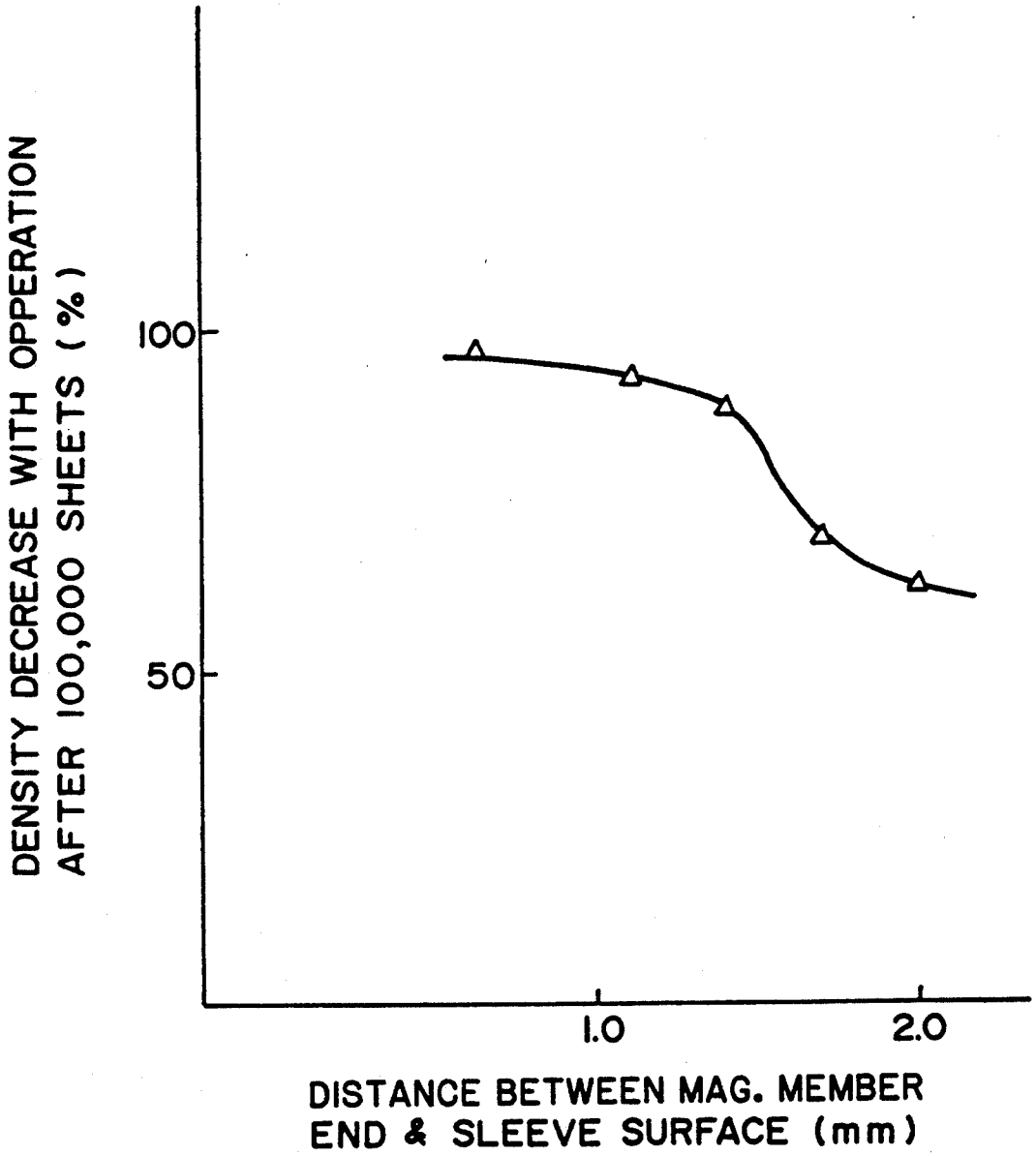
FIG. 3 is a graph of a density decrease with operation after 100,000 sheets are developed (%) vs. a distance between an end of the magnetic member and a sleeve surface (mm).

FIG. 3 shows, as an example, the relationship between the rate of the density decrease after 100,000 sheets are developed and the distance between the end of the magnetic member and the sleeve surface with the following conditions:

- The clearance d1 between the sleeve and the drum: 450 microns
- The clearance d2 between the end of the non-magnetic member 50 and the sleeve surface: 600 microns
- The angle $\theta$ formed between the non-magnetic member 24 and the regulating magnetic pole 23a with respect to the center of the sleeve:
- The thickness t of the magnetic member 50 disposed upstream of the non-magnetic member 24 with respect to movement direction of the developer: 0.5 mm
- The volumetric ratio of the magnetic member in the developing zone: maintained at 12% by changing the width 1 of the magnetic member 50 and the distance between the magnetic member end and the sleeve surface.

As will be understood from FIG. 3, the image density decrease is large if the clearance d3 is larger than 1.5 mm. The reason for this is considered as being that with the increase of the clearance d3, an extremely strong, local and extremely high density concentrated magnetic field is required, and therefore, the stress to the toner provided by the carrier becomes extremely large with the result of promotion of the toner deterioration. In order to form the strong, local and high density concentrated magnetic field, it is required that the width of the magnetic member is increased to increase the volume. Even if the dimensions d2, 1 and t are changed, the clearance d3 is preferably not more than 1.5 mm.

Figure 4:
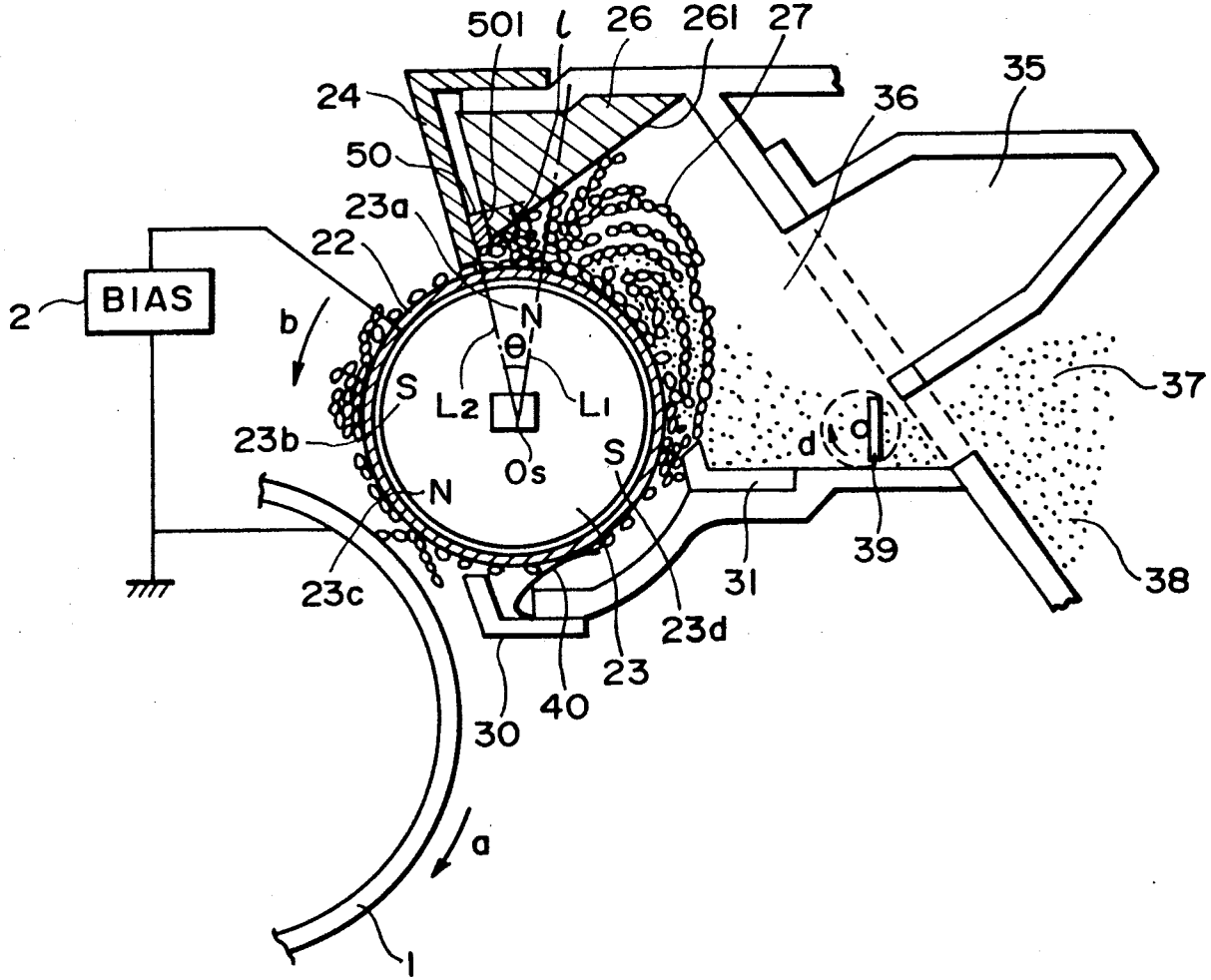
FIG. 4 is a cross-sectional view of a developing apparatus according to another embodiment of the present invention.

FIG. 4 illustrates a developing device wherein the magnetic particles and toner particles are mixed and stirred on the developing sleeve. The description will be made as to this developing device to which the present invention is applied. The structures same as the above embodiment will not be described for the sake of simplicity.

In FIG. 4, and also in FIG. 5 which will be described hereinafter, the N pole 23*c* of the stationary magnet 23 functions as a developing magnetic pole actable to the developing zone.

In FIG. 4, there is provided a limiting member of non-magnetic material having a developer guiding surface 261 extending to the regulating zone. The guiding surface 261 is so inclined that the clearance between the sleeve 22 and the guiding surface 261 is gradually decreased toward the downstream of the sleeve rotation, whereby the developer is accumulated upstream of the developer layer thickness regulating zone where the members 24 and 50 are provided. From the accumulated portion, a predetermined amount of developer is conveyed out through the regulating zone.

As shown in the Figure, the magnetic particles (carrier particles) 27 are concentrated in the container in the form of a layer adjacent to the outer surface of the sleeve 22. The toner is taken into the magnetic particle layer from the outside thereof by the motion of the magnetic particles provided by the rotation of the sleeve. A magnetic member 31 is disposed opposed to the developing sleeve 22 at a lower inside surface of the developer container in order to prevent leakage of the magnetic particles 27 and/or the non-magnetic toner particles 37 from the bottom portion of the developer container 36. The magnetic member 31 is a plated steel plate, for example, bent into "L" shape. The magnetic field formed between the magnetic member 31 and the S magnetic pole 23*d* are effective to allow the magnetic particles 27 to return into the container and to prevent leakage of the toner and magnetic particles from the container, thus sealing the container.

The inventors' experiments show that the magnetic carrier particles are substantially completely returned into the container, and the toner particles are not leaked, and the developing operation is stabilized, when the distance between the developing sleeve and the magnetic member 31 is 2.5 mm.

The member 31 may be of a weakly magnetic material, or may be of a magnet. When the member 31 is of magnet, an N pole which is the opposite in polarity to the polarity S of the magnetic pole 23*d* is opposed to the sleeve 22.

A toner supplying member 39 serves to supply the toner to the magnetic particle brush formed by the stationary magnet 23 in the developing sleeve 22. The toner supplying member 39 includes a metal plate rotatably supported and covered by a rubber sheet, and rotates as if it sweeps the bottom inside surface of the container to convey the toner. The toner supplying member 39 is supplied with the toner by a toner conveying member not shown in the toner container 38.

Designated by reference numerals 38 and 35 are the toner container and a magnetic particle container.

A sealing member 40 is made of elastic material and is effective to prevent the toner stagnating at the lower portion of the developer container 36 from leaking out. The sealing member is bent codirectionally with the rotation of the sleeve 22, and is resiliently urged to the surface of the sleeve 22. The sealing member 40 has an end at the downstream end of the contact area with the sleeve 22 with respect to rotational direction of the sleeve so as to allow reintroduction of the developer into the container.

A scatter preventing electrode plate 30 is supplied with a voltage having a polarity, the same as that of the floating toner produced by the developing operation so as to cause such toner particles to be deposited on the photosensitive member, thus preventing the toner from scattering around.

By not providing the magnetic pole between the magnetic pole 23*d* and the magnetic pole 23*a*, the magnetic brush of the magnetic particles is formed extending along the sleeve surface in the lower portion of the container 36 where the toner is supplied into the magnetic brush. Therefore, the magnetic brush is not sparse, whereby the amount of the toner taken into the magnetic powder is prevented from becoming extremely large. If an extreme amount of toner is taken into it, the charge of the toner becomes insufficient, resulting in production of foggy background.

The structure is also effective when the developer container contains a mixture of the magnetic particles and non-magnetic particles or weakly magnetic toner particles.

In FIG. 4, the magnetic member 50 made of iron having a width 1 is disposed to the non-magnetic blade side of the developer regulating member 26. In this case, the magnetic member 50 has a thickness of 200 microns and a length 1 of 10 mm wherein an end of the magnetic member 50 is spaced from the surface of the sleeve 22 by a distance d3 which is 700 microns. The clearance d2 between the non-magnetic blade 24 end and the developing sleeve 22 is 650 microns. Similarly to the foregoing embodiment, the clearance d2 between the non-magnetic plate 24 and the surface of the sleeve 22 is preferably not less than 500 microns and not more than 1 mm. The clearance d3 between the magnetic plate 50 and the surface of the sleeve 22 is larger than the clearance d2, and is preferably not less than 600 microns and not more than 1.5 mm.

An angle $\theta$ between the magnetic pole 23*a* and the magnetic member 50 with respect to the center of the sleeve 22 will be described. The relation between the angle $\theta$ and the amount of application is the same as in the first embodiment, as shown in FIG. 2. In FIG. 2, the angle between the non-magnetic plate 24 and the magnetic pole 23*a* is shown, but in FIGS. 1, 4 and 5, the non-magnetic plate and the magnetic plate are integral, so that the angle formed between the magnetic plate 50 and the magnetic pole 23*a* are deemed as being substantially equal to the angle formed between the non-magnetic plate 24 and the magnetic pole 23*a*. In FIGS. 1, 4 and 5, a line L1 is a line connecting the rotational center of the sleeve 22 and a maximum magnetic flux density position on the surface of the sleeve 22 by the magnetic pole 23*a*. A line L2 is a line connecting a rotational center of the sleeve 22 and an end, closest to the sleeve 22, of the surface of the non-magnetic plate 24, the surface being the magnetic plate 50 side surface of the two surfaces defining a thickness thereof in the direction of the rotation of the sleeve. Since the non-magnetic plate 24 and the magnetic plate 50 are joined or extremely close, the angle $\theta$ formed by the two lines L1 and L2 is substantially equal to an angle formed between the line L1 and a line connecting the center of the sleeve 22 and an end, closest to the sleeve 22 of the non-magnetic plate 24 side surface of the magnetic plate 50, the surface being one of the surfaces of the magnetic plate 50 defining the thickness thereof.

The volumetric ratio of the magnetic particles is preferably determined such that the image density is high, and the image is fine. If the amount of the magnetic particles is small, the toner is easily extremely charged up when the humidity is low, and therefore, for the purpose of further enhancing the image quality, the volumetric ratio of 9–26% which is smaller in the range at the lower side than in the above described, is preferable. Also, it is desirable that the magnetic brush in the regulating zone is relatively soft. In view of this, the magnetic blade 50 is not disposed right opposed to the maximum magnetic flux density position by the magnetic pole 23*a*, and the angle therebetween is preferably 5–30 degrees.

Figure 5:
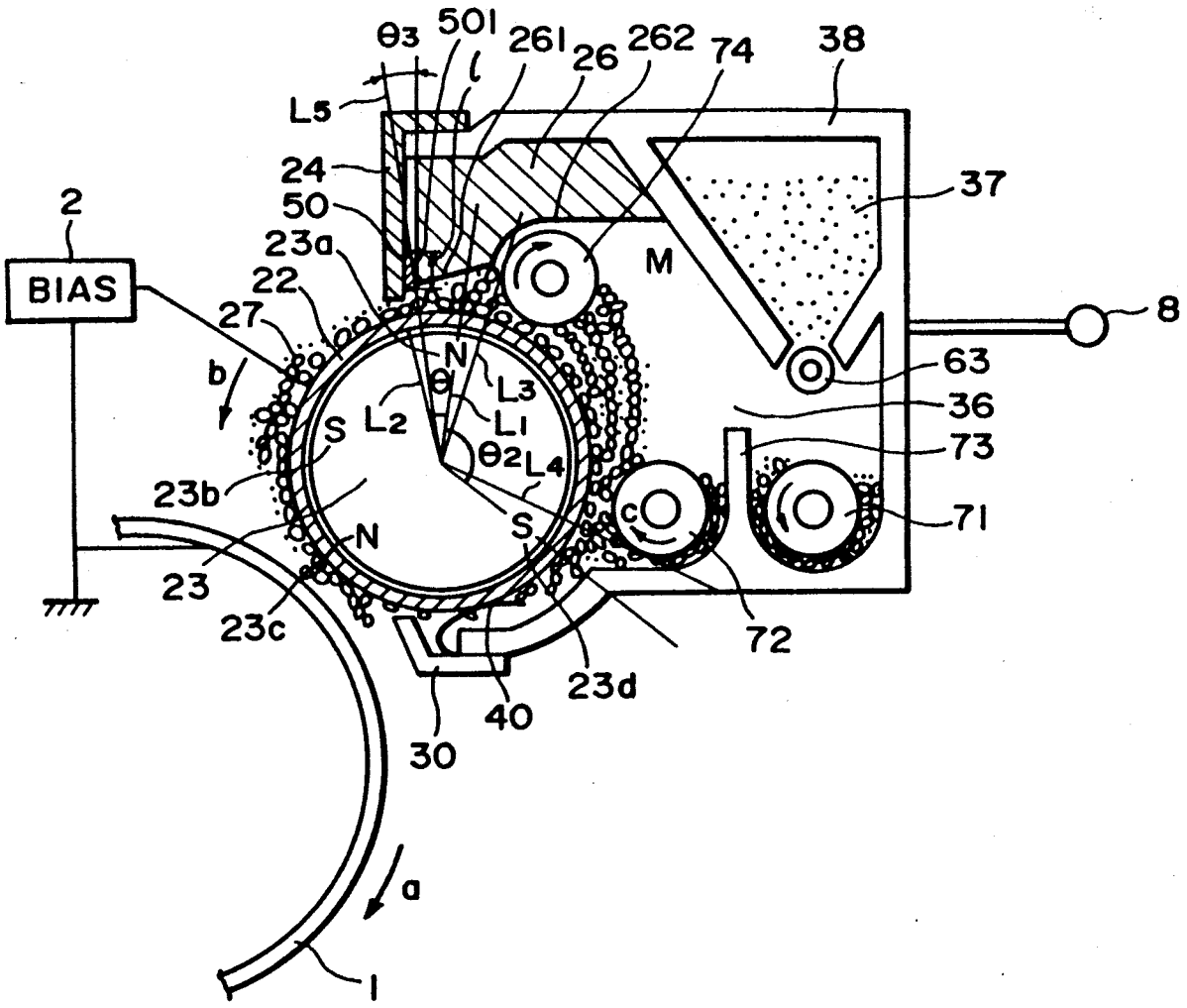
FIG. 5 is a cross-sectional view of a developing apparatus according to a further embodiment of the present invention.

FIG. 5 shows a further embodiment, wherein the structures of the regulating zone and the developing zone are the same as those of FIG. 4 embodiment with the exception that the magnetic plate 50 is made of a magnetic nickel plate having a length 1 of 3 mm and a thickness of 1 mm measured along the movement direction of the developer. In this embodiment, screws 71, 72 and 74 are provided as a means for stirring and conveying the developer. The screws 71 and 72 are separated by a partition wall 73 having an opening for allowing passage of the developer. The screws 72 and 74 are close enough to the sleeve 22 to stir the developer layer magnetically retained on the sleeve 22. With this arrangement, the circulation of the developer in the container is improved, and therefore, the developing device can be revolved. In this embodiment, the developing device is revolvable about the shaft 8 so as to selectively take a non-operative position in which the developing device is away from the developing zone and an operative position wherein the sleeve 22 is closely opposed to the photosensitive drum 1 to develop the latent image thereon. By revolving the developing device in this manner foreign matter and coagulated developer retained in dead spaces in the developing device are driven out to the neighborhood of the sleeve, the white stripes tend to easily appear in the image. However, when the structure is as shown in FIG. 5, no white stripes appear even after 100,000 sheets are developed. Also, since the circulation is good, it is possible to use a sleeve having a diameter of 9–25 mm.

The features of FIG. 5 embodiment are as follows:

In the developing device comprising a developer container for containing a developer including toner particles and the magnetic carrier particles, a developer carrying member which is opposed to a latent image bearing member bearing a latent image to establish a developing zone for supplying the toner particles to the latent image bearing member and which is effective to carry the developer from the developer container to the developing zone, stationary magnetic field generating means disposed across the developer carrying member from the developer carrying surface thereof and means for regulating the amount of magnetic carrier particles and toner particles applied on the surface of the developer carrying member, wherein the developer containing the magnetic carrier particles and the toner particles is supplied into the developing zone to develop the latent image:

(1) The stationary magnetic field generating means has a first stationary magnetic field generating portion and a second stationary magnetic field generating portion which are disposed in this order with respect to movement detection of the developer carrying member and which sandwiches the central portion of the developer carrying member opposed to the developer container, and the developing apparatus further comprises a first stirring member disposed to the first stationary magnetic field generating portion side and a second stirring member disposed at the second stationary magnetic field generating portion side and disposed above the first stirring member, wherein all of the maximum stirring action zones of the first stirring member and the second stirring member are located within the angle $\theta_2$ formed between the maximum magnetic flux density position of the magnetic field on the surface of the developer carrying member provided by the first stationary magnetic field generating portion and the maximum magnetic flux density position of the magnetic field on the developer carrying member surface provided by the second stationary magnetic field generating portion with respect to a rotational center of the developer carrying member:

(2) The stationary magnetic field generating means includes a first stationary magnetic field generating portion and a second stationary magnetic field generating portion which are disposed in this order with respect to movement of the developer carrying member and which sandwiches a central portion of the developer carrying member opposed to the developer container, and said regulating means is disposed downstream of the second magnetic field generating portion with respect to movement detection of the developer carrying member and is provided with a magnetic member disposed in the magnetic field provided by the second magnetic field generating portion, said developing device further comprises a first stirring member disposed at the first stationary magnetic field generating portion side and a second stirring member disposed at the second stationary magnetic field generating portion side and disposed above the first stirring member, wherein all of the maximum stirring action regions provided by the first stirring member and the second stirring member are disposed within an angle $\theta_2$ formed between the maximum magnetic flux density position on the developer carrying surface provided by the first stationary magnetic field generating portion and the maximum magnetic flux density position on the developer carrying surface provided by the second stationary magnetic field generating portion with respect to the rotational center of the developer carrying member, and wherein the second stirring member is moved in the same direction as the developer carrying member in the region opposed to the developer carrying member: and (3) Said stationary magnetic field generating means includes a stationary magnetic field generating portion for producing a stationary magnetic field influential to said regulating means, said regulating means includes a magnetic member and a non-magnetic member downstream of the stationary magnetic field generating portion with respect to the movement direction of the developer carrying member, the developing device further comprises a stirring member disposed upstream of the stationary magnetic field generating portion with respect to the movement direction of the developer carrying member and close to the stationary magnetic field generating portion through the developer carrying member and having a portion opposed to the developer carrying member movable codirectionally with the developer carrying member, and a developer guiding member disposed so as to cover the developer carrying member in the range from the magnetic member to the stirring member.

The "maximum stirring action region" means the trace of rotation of the maximum radius portion of each of the screws 72 and 74.

The screws 71, 72 and 74 convey the developer along the length of the sleeve 22 while stirring the developer, wherein the direction of conveyance by the screw 72 is opposite to that of the screw 71, and wherein the developer conveyance direction of the screw 74 is opposite to that of the screw 72. The screw 71 is effective to mix the carrier particles and the toner particles supplied from the toner container and to deliver it to the screw 72.

Adjacent to the magnetic pole 23*d*, the screw 72 disposed adjacent to the sleeve 22 functions to exchange the developer returned after the development and fresh developer conveyed by the screw 72.

It is preferable that the screw 72 is disposed downstream of the maximum magnetic flux density position by the magnetic pole 23*d* with respect to the rotational movement direction of the sleeve 22 and that at least part thereof is disposed within the influence of the magnetic field by the magnetic pole 23*d*. This is because the amount of the fresh developer exchanged is more appropriate, and the toner content distribution is more uniform if the magnetic brush which is not erected and which is at a high density is stirred than if the magnetic brush which is erected and which is sparse is stirred.

The clearance between the screw 72 and the sleeve 22 is preferably 1–5 mm, since it is larger, the exchange rate decreases. The clearance was 3 mm in this embodiment.

The screw 74 functions to uniformize, in the direction of the length of the developing sleeve, the amount of the developer conveyed to the regulating zone at a position immediately before the regulating zone. By this, the pressure of the developer in the developing zone is stabilized. The supplied developer is uniformized in the direction of the length of the sleeve and is forced into the regulating zone, and simultaneously, an excessive amount of the developer is discharged into the space M through the clearance between the guiding surface 262 of the curved surface to maintain the pressure to the magnetic particles in the regulating zone is made constant. By this, the thickness and the toner content of the developer layer formed by the members 50 and 24 are made more uniform in the direction of the length of the sleeve. The screw 74 is preferably disposed upstream of the maximum magnetic flux density position by the magnetic pole 23*a* with respect to the sleeve rotation direction, and is preferably disposed in the latter half of the developer conveying passage from the magnetic pole 23*a* to the magnetic pole 23*d*. If it is disposed in the former half, the uniformization in the longitudinal direction of the sleeve is slightly weakened. The angle formed between the line L1 and a line L3 passing through the center of the sleeve and tangent to the maximum stirring action region of the screw 74 is preferably 0–40 degrees. Without the influence of the magnetic force by the magnetic pole 23*a*, the conveyance of the developer in the direction parallel to the sleeve axis becomes not sufficient, and therefore, at least a portion of the screw 74 is preferably disposed within influence of the magnetic force by the magnetic pole 23*a*.

If the magnetic force by the magnetic pole 23*d* is stronger than that of the magnetic pole 23*a*, the amount of the developer present on the sleeve from the screw 74 to the regulating zone decreases, so that the uniform application becomes difficult. Also, the conveyance of the developer in the longitudinal direction of the screw 74 becomes worse, and the uniformizing action by the screw 74 in the longitudinal direction of the sleeve is worsened. Therefore, it is preferable that the magnetic force by the magnetic pole 23*d* is decreased than that of the magnetic pole 23*a* so that the amount of the developer in that region is increased.

The maximum magnetic flux density by the magnetic pole 23*a* is not less than 600 Gausses on the sleeve surface, preferably not less than 700 Gausses. This is because the state of application of the developer is stabilized with increased magnetic flux density by the regulating magnetic pole 23*a* against toner content change of the magnetic particle layer. Particularly when the developing device is not equipped with an automatic toner supplying means for maintaining the toner content, the maximum magnetic flux density on the surface of the sleeve is preferably not less than 800 Gausses.

Since, however, the developer is deteriorated with the increase of the magnetic force by the magnetic pole 23*a*, and the conveying force is increased, it should be properly selected so as to avoid excessive increase of the amount of applied toner on the sleeve. The inventors' experiments have shown it is preferably not more than approximately 1200 Gausses.

In FIGS. 4 and 5, the magnetic pole 23*c* is a developing magnetic pole. The developing magnetic pole is disposed substantially in the developing zone, and the magnetic flux density on the sleeve surface is preferably not less than 800 Gausses on the sleeve surface in order to prevent deposition of the magnetic particles onto the latent image.

As described in the foregoing, in the developer layer forming device wherein the upstream side magnetic force is concentrated on a magnetic field concentrating surface of a magnetic member, and the magnetic developer is regulated by a non-magnetic regulating blade, the width of the magnetic member is smaller than those in the conventional device, more particularly, not less than 1 mm and not more than 10 mm. This has been empirically confirmed. If the length is not less than 2.5 mm and not more than 7 mm, a uniform magnetic field concentration to this surface of the magnetic member is accomplished. The thickness of the magnetic member is not less than 0.2 mm and not more than 3 mm, preferably, not less than 0.5 mm and not more than 2.0 mm.

The results of experiments are shown in Table 1.

TABLE 1

| | Width | | | | | | | |
|---|---|---|---|---|---|---|---|---|
| Thickness | 0.8 | 1.0 | 2.5 | 3.0 | 4.0 | 7.0 | 10 | 12 |
| 0.1 | N | N | N | N | N | N | N | N |
| 0.2 | N | N | G | G | G | G | G | N |
| 0.5 | N | G | E | E | E | E | E | N |

TABLE 1-continued

| Thickness | Width 0.8 | 1.0 | 2.5 | 3.0 | 4.0 | 7.0 | 10 | 12 |
|---|---|---|---|---|---|---|---|---|
| 1.0 | N | G | E | E | E | E | E | N |
| 2.0 | N | N | E | E | E | G | N | N |
| 2.2 | N | N | G | E | E | G | N | N |
| 3.3 | N | N | N | G | G | N | N | N |
| 3.2 | N | N | N | N | N | N | N | N |

In the experiments, the magnetic member 50 is substantially rectangular in the cross section by a plane perpendicular to the rotational axis of the sleeve, in other words, a plane parallel to the developer conveyance direction, and the width and thickness of the magnetic member 50 are changed. In this table, "G" indicates that after 100,000 sheets (A4, JIS) are copied, the image density is 80–90% of the initial image density; "E" indicates that it is not less than 90%, and the developer layer is stabilized; and "N" indicates that it is less than 80 % or the developer layer is unstable so that the image density varies. The "N" marks in the upper part of the table indicate that the regulating force is so weak that the developer layer is unstable, whereas "N" marks in the lower part indicate that the image density decrease is significant.

Figure 6:
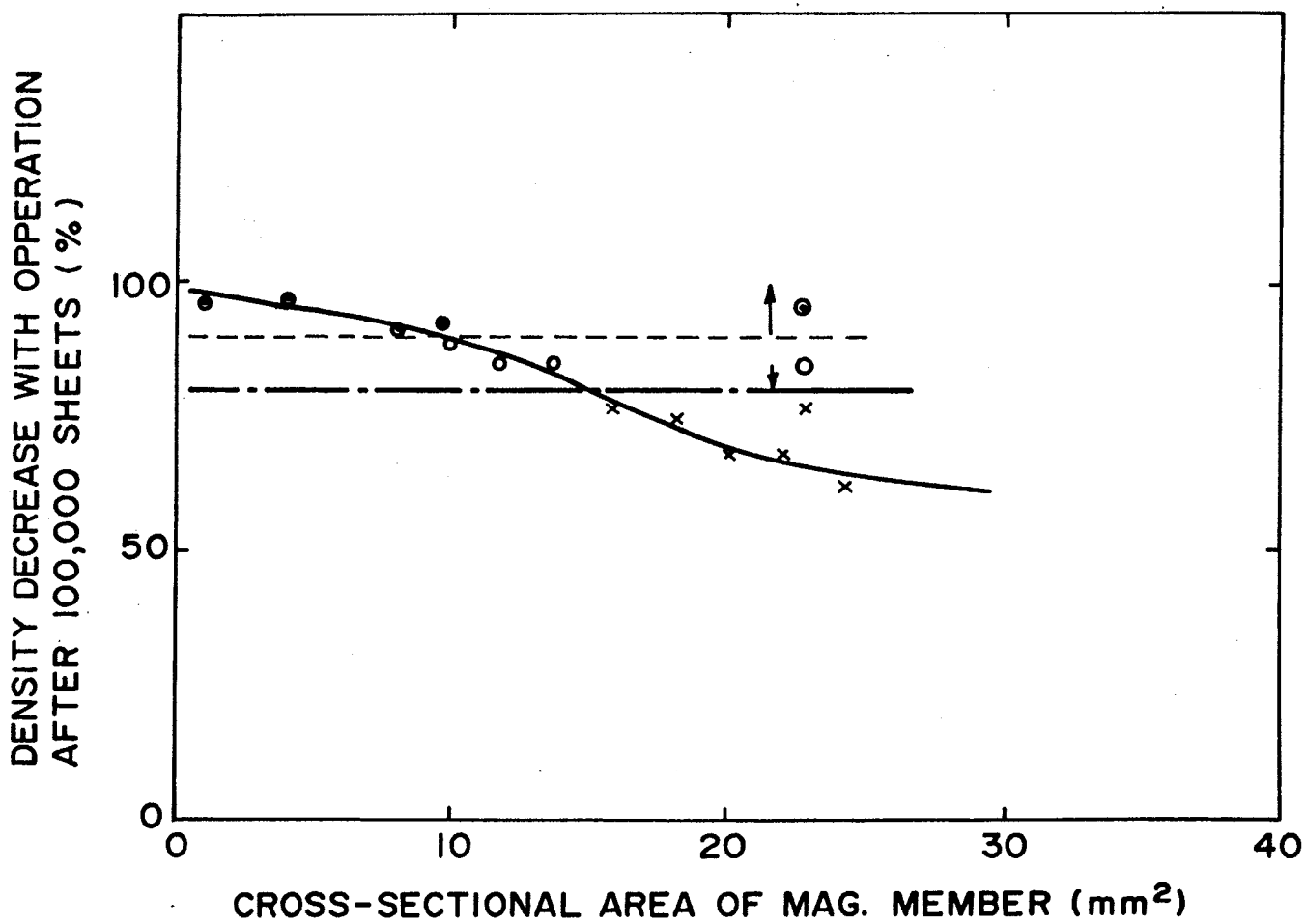
FIG. 6 is a graph of a density decrease with operation after 100,000 sheets are developed (%) vs. a cross-sectional area of a magnetic member ($mm^2$).

When the cross sectional area of the magnetic member by the above plane is taken as a parameter, the results shown in FIG. 6 were obtained. (" ", "O" and "X" shown in the Figure refer to "E", "G" and "N" of the Table, respectively). FIG. 6 shows the ratio of the image density after 100,000 sheets (A4, JIS) are copied to the initial image density. The cross sectional area (width multiplied by thickness) is preferably not more than 15 $mm^2$, since then the ratio is not less than 80%. Not more than 10 $mm^2$ is particularly preferable, since the ratio is not less than 90%. If, however, the cross sectional area is less than 0.5 $mm^2$, the developer layer is unstable so that it is not preferable. If the thickness is relatively small, and therefore, the shape is relatively wide, the regulating effect by the magnetic force is decreased with the result that the developer layer is not stabilized. Therefore, it is preferable that the thickness is not less than 0.2 mm and that the width is not more than 10 mm, the same as the above described.

The inclination angle $\theta_3$ of the magnetic member, that is, the angle formed between a line L5 connecting the center of the sleeve and the end of the magnetic member adjacent to the sleeve (a line normal to the sleeve surface) and the long axis of the magnetic member is preferably not less than −45 degrees and not more than 60 degrees, further preferably, not less than −20 degrees and not more than 20 degrees.

Table 2 shows the results of experiments.

TABLE 2

| $\theta_3$ (degree) −60 | −50 | −45 | −40 | −20 | 0 | 20 | 40 | 60 | 65 | 75 |
|---|---|---|---|---|---|---|---|---|---|---|
| N | N | G | G | E | E | E | G | G | N | N |

"G" and "E" indicate the same as with Table 1.

"N" indicates in this table that the image density after 100,000 sheets (A4, JIS) are copied, the image density decreases down to less than 80% of the initial image density. When the angle $\theta$ is 65 and 75 degrees, a small angle wedge shaped space is formed between the magnetic member and the sleeve surface, and the developer is easily clogged therein by the cooperation with the magnetic confining force, so that the toner is excessively triboelectrically charged and deteriorated, with the result that "N" mark is given. When the angle $\theta_3$ is −50 degrees or −60 degrees, the edge of the magnetic member adjacent to the sleeve is close to the magnetic pole 23a, and therefore, the magnetic field is strongly concentrated locally on the edge, so that the magnetic confining force to the developer is too strong, and therefore, the toner is excessively charged triboelectrically and deteriorated, and as a result, "N" mark is given.

The positiveness of the value of the angle $\theta_3$ means that the angle is measured from the line L5 toward the upstream side with respect to sleeve rotation, and the negativeness thereof means the angle thereof from the line L5 toward the downstream with respect to the sleeve rotation.

The cross sectional area of the magnetic member is not limited to the rectangular shape, but may be a flat trapezoidal, wedge shaped or the like. When the cross-section is rectangular, the width means the dimension of the longer side, and the thickness means the dimension of the shorter side, and a line extending through a center of the cross-section and parallel to the longer side is called long axis. When the cross-section is not rectangular, the width is determined as the longest line between any two points on the sides of the cross-section, and the line is called long axis, and an average of the dimension perpendicular to the long axis is called thickness. By applying those definitions of the width, thickness and long axis, the above-described preferable dimensions are applied when the cross section is not rectangular such as wedge, flat trapezoidal or the like.

In the foregoing embodiment, the magnetic member 50 is attached to the non-magnetic blade 24, in other words, the clearance between the magnetic member 50 and the non-magnetic blade 24 is 0, but the clearance between the magnetic member 50 and the non-magnetic blade in the direction of the sleeve rotation is preferably not less than 0 and not more than 3 mm. If the clearance is larger than 3 mm, the amount of the magnetic carrier particles stagnating in the clearance increases with the result that the magnetic field is strongly concentrated, and therefore, the inconveniences as when the dimension of the magnetic member 50 is increased, result, and therefore, it is not preferable.

As for the material of the magnetic member 50, usable are ferromagnetic material such as cobalt or magnetic stainless steel in addition to the above-described iron or steel and nickel.

The present invention is applicable particularly to a color image forming apparatus using soft and high resistivity toner to meet the required fixing property. As for the color toner, a usable example is a toner including as a major component styrene-acrylic acid ester resin or polyester resin or other binding resin and color pigment or dye, and if necessary, electrification agent mixed together, having an average particle size of 5–20 microns and volume resistivity of not less than $10^{13}$ ohm.cm. The mixture ratio of the toner relative to the carrier is 5–15% by weight as an example, preferably 6–13% by weight. Fine silica particles may be added to increase the fluidability of the developer.

In the image forming device wherein the developing device is revolved as typically shown in U.S. Pat. No. 4,622,916 or Japanese Laid-Open Patent Application No. 260073/1985, the coagulated developer retained in the dead space in the developing device normally is easily driven out by the revolution and is introduced into the conveyed developer, as described with FIG. 5. According to the present invention, the coagulated developer is prevented from clogging the regulating zone, and the present invention is particularly usable with the developing device movable between the operative position and non-operative position. However, the present invention is applicable to a stationary type developing device, as will be understood from the foregoing description.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:

rotatable developer carrying sleeve for carrying a developer containing magnetic carrier and non-magnetic toner to a developing zone;

means for generating a stationary magnetic field, said magnetic field generating means comprising a first magnetic pole and a second magnetic pole disposed adjacent to and downstream of said first magnetic pole with respect to a direction of conveyance of the developer by said rotatable developer carrying sleeve;

regulating means, disposed across said rotatable developer carrying sleeve from said stationary magnetic field generating means, for regulating a thickness of a layer of the developer formed on said rotatable developer carrying sleeve, said regulating means being disposed between said first magnetic pole and said second magnetic pole, said regulating means comprising a magnetic member, having an end surface opposed to said developer carrying sleeve, and a side surface having a width larger than that of said end surface, and disposed downstream of said first magnetic pole of said stationary magnetic field generating means with respect to a direction of conveyance of the developer by said rotatable developer carrying sleeve, a non-magnetic member disposed downstream of said magnetic member with respect to the developer conveyance direction with a space from said rotatable developer carrying sleeve which is smaller than a space between said magnetic member and said rotatable developer carrying sleeve, said magnetic member having a width of not less than 1 mm and not more than 10 mm and a thickness of not less than 0.2 mm and not more than 3 mm, and said magnetic member being cooperable with said first magnetic pole to form a concentrated magnetic field for permitting passage of the magnetic carrier, wherein a long axis in a cross-section of the magnetic member forms an angle of not less than −45 degrees and not more than 60 degrees with a line normal to a surface of said rotatable developer carrying sleeve, wherein a closest clearance d2 (mm) between the surface of said rotatable developer carrying sleeve and said non-magnetic member, and a closest clearance d3 (mm) between said magnetic member and the surface of said rotatable developer carrying sleeve satisfy the relationship:

$$0.5\ \text{mm} \leqq d2 < d3 \leqq 1.5\ \text{mm},$$

wherein an angle formed between said magnetic member and said first magnetic pole is not less than 5 degrees and not more than 30 degrees, and wherein magnetic flux from said first magnetic pole is mainly concentrated on the side surface of said magnetic member.

2. A developing apparatus to claim 1, wherein the width of the magnetic member is not less than 2.5 mm and not more than 7 mm, and the thickness is not less than 0.5 mm and not more than 2 mm.

3. An apparatus according to claim 1 or 2, wherein a maximum magnetic flux density on the surface of the sleeve provided by said first magnetic pole is not less than 600 Gauss and not more than 1200 Gauss.

4. An apparatus according to claim 1 or 2, wherein a closest clearance d1 between said rotatable developer carrying sleeve and an image bearing means to which it is opposed, satisfies $d1 < d2$.

5. An apparatus according to claim 1 or 2, wherein a clearance between said magnetic member and said non-magnetic member measured along a direction of conveyance of the developer by said rotatable developer carrying sleeve is not less than 0 mm and not more than 3 mm.

6. An apparatus according to claim 4, wherein the clearance d1 is not more than 0.6 mm, and the clearance d2 is not more than 1 mm.

7. An apparatus according to claim 4, further comprising means for forming a vibratory electric field in the developing zone where said developer carrying means and the image bearing member are opposed.

8. An apparatus according to claim 7, wherein the magnetic carrier particles have an average particle size of not less than 20 microns and not more than 100 microns, saturation magnetization of not less than 30 emu/g and not more than 100 emu/g, a volume resistivity of not less than $10^7$ ohm.cm and not more than $10^{13}$ ohm.cm, and the non-magnetic toner particles have an average particle size of not less than 5 microns and not more than 20 microns and a volume resistivity of not less than $10^{13}$ ohm·cm.

9. An apparatus according to claim 7, wherein the volumetric ratio of the magnetic carrier is not less than 1.5% and not more than 30% in the developing zone.

10. An apparatus according to claim 9, wherein the volumetric ratio is not less than 9% and not more than 26%.

11. A developing apparatus, comprising:

rotatable developer carrying sleeve for carrying a developer containing magnetic carrier and non-magnetic toner to a developing zone;

means for generating a stationary magnetic field, said magnetic field generating means comprising a first magnetic pole and a second magnetic pole disposed adjacent to and downstream of said first magnetic pole with respect to a direction of conveyance of the developer by said rotatable developer carrying sleeve;

regulating means, disposed across said rotatable developer carrying sleeve from said stationary magnetic field generating means, for regulating a thickness of a layer of the developer formed on said rotatable developer carrying sleeve, said regulating means being disposed between said first magnetic pole and said second magnetic pole, said regulating means comprising a magnetic member, having an end surface opposed to said developer carrying sleeve, and a side surface having a width larger than that of said end surface, and disposed downstream of said first magnetic pole of said stationary magnetic field generating means with respect to a direction of conveyance of the developer by said rotatable developer carrying sleeve, a non-magnetic member disposed downstream of said magnetic member with respect to the developer conveyance direction with a space from said rotatable developer carrying sleeve which is smaller than a space between said magnetic member and said rotatable developer carrying sleeve, said magnetic member having a cross-sectional area of not less than 0.5 $mm^2$ and not more than 15 $mm^2$, and said magnetic member being cooperable with said first magnetic pole to form a concentrated magnetic field for permitting passage of the magnetic carrier, wherein an axis perpendicular to the plane of the cross-section forms an angle of not less than −45 degrees and not more than 60 degrees with a line normal to a surface of said rotatable developer carrying means, wherein said magnetic member has a width of not more than 10 mm and a thickness of not less than 0.2 mm, wherein a closest clearance d2 (mm) between the surface of said rotatable developer carrying sleeve and said non-magnetic member, and a closest clearance d3 (mm) between said magnetic member and the surface of said rotatable developer carrying sleeve satisfy the relationship:

$$0.5\ mm \leqq d2 \leqq d3 \leqq 1.5\ mm,$$

wherein an angle formed between said magnetic member and said first magnetic pole is not less than 5 degrees and not more than 30 degrees, and wherein magnetic flux from said first magnetic pole is mainly concentrated on the side surface of said magnetic member.

12. An apparatus according to claim 11, wherein said cross-sectional area is not more than 10 $mm^2$.

13. An apparatus according to claim 11 or 12, wherein a maximum magnetic flux density on the surface of the sleeve provided by said first magnetic pole is not less than 600 Gauss and not more than 1200 Gauss.

14. An apparatus according to claim 13, wherein a closest clearance d1 between said rotatable developer carrying sleeve and an image bearing means to which it is opposed, satisfies the relationship $d1 < d2$.

15. An apparatus according to claim 14, wherein the clearance d1 is not more than 0.6 mm, and the clearance d2 is not more than 1 mm.

16. An apparatus according to claim 14, wherein a clearance between said magnetic member and said non-magnetic member, measured along a direction of conveyance of the developer by said rotatable developer carrying sleeve, is not less than 0 mm and not more than 3 mm.

17. An apparatus according to claim 16, further comprising means for forming a vibratory electric field in the developing zone where said rotatable developer carrying sleeve and the image bearing member are opposed.

18. An apparatus according to claim 17, wherein the magnetic carrier particles have an average particle size of not less than 20 microns and not more than 100 microns, saturation magnetization of not less than 30 emu/g and not more than 100 emu/g, a volume resistivity of not less than $10^7$ ohm·cm and not more than $10^{13}$ ohm·cm, and the non-magnetic toner particles have an average particle size of not less than 5 microns and not more than 20 microns and a volume resistivity of not less than $10^{13}$ ohm·cm.

19. An apparatus according to claim 17, wherein the volumetric ratio of the magnetic carrier is not less than 1.5% and not more than 30% in the developing zone.

20. An apparatus according to claim 19, wherein the volumetric ratio is not less than 9% and not more than 26%.

21. A developing apparatus, comprising:

rotatable developer carrying sleeve for carrying a developer containing magnetic carrier and non-magnetic toner;

means for generating a stationary magnetic field, said magnetic field generating means comprising a first magnetic pole and a second magnetic pole disposed adjacent to and downstream of said first magnetic pole with respect to a direction of conveyance of the developer by said rotatable developer carrying sleeve;

regulating means, disposed across said rotatable developer carrying sleeve from said stationary magnetic field generating means, for regulating a thickness of a layer of the developer formed on said rotatable developer carrying sleeve, and regulating means being disposed between said first magnetic pole and said second magnetic pole, said regulating means comprising a magnetic member, having an end surface opposed to said developer carrying sleeve, and a side surface having a width larger than that of said end surface, and disposed downstream of said first magnetic pole of said stationary magnetic field generating means with respect to a direction of conveyance of the developer by said rotatable developer carrying sleeve, a non-magnetic member disposed downstream of said magnetic member with respect to the developer conveyance direction with a space from said rotatable developer carrying sleeve which is smaller than a space between said magnetic member and said rotatable developer carrying sleeve, and said magnetic member being cooperable with said first magnetic pole to form a concentrated magnetic field for permitting passage of the magnetic carrier;

guiding means disposed upstream of said regulating means with respect to the conveyance direction and having guiding means for guiding the developer adjacent said regulating means, wherein said guiding means has a surface for guiding the developer to said regulating means; and stirring means for stirring the developer, said stirring means being disposed upstream of said first magnetic pole with respect to the developer conveyance direction and between said guiding means and said rotatable developer carrying sleeve, wherein said magnetic member has a width of not less than 1 mm and not more than 10 mm, a thickness of not less than 0.2 mm and not more than 3 mm, and wherein a long axis of a cross-section of said magnetic member forms an angle of not less than −45 degrees and not more than 60 degrees with a line normal to a surface of said rotatable developer carrying sleeve, wherein a closest clearance d2 (mm) between the surface of the said rotatable developer carrying sleeve and said non-magnetic member, and a closest clearance of d3 (mm) between said magnetic member and the surface of said rotatable developer carrying sleeve satisfy the relationship:

$$0.5\ \text{mm} \leqq d2 \leqq d3 < \leqq 1.5\ \text{mm},$$

wherein an angle formed between said magnetic member and said first magnetic pole is not less than 5 degrees and not more than 30 degrees, and wherein magnetic flux from said first magnetic pole is mainly concentrated on the side surface of said magnetic member.

22. An apparatus according to claim 21, wherein said magnetic member has a cross-sectional area of not less than 0.5 $mm^2$ and not more than 15 $mm^2$.

23. An apparatus according to claim 21 or 22, wherein a maximum magnetic flux density on the surface of the sleeve provided by said first magnetic pole is not less than 600 Gauss and not more than 1200 Gauss.

24. An apparatus according to claim 23, wherein the closest clearance d1 between said developer carrying means and an image bearing means to which it is opposed, satisfies $d1 < d2$.

25. An apparatus according to claim 24, wherein the clearance 31 is not more than 0.6 mm, and the clearance d2 is not more than 1 mm.

26. An apparatus according to claim 24, wherein a clearance between said magnetic member and said non-magnetic member, measured along a direction of conveyance of the developer by said rotatable developer carrying sleeve, is not less than 0 mm and not more than 3 mm.

27. An apparatus according to claim 26, further comprising means for forming a vibratory electric field in the developing zone where said rotatable developer carrying sleeve and the image bearing member are opposed.

28. An apparatus according to claim 27, wherein the magnetic carrier particles have an average particle size of not less than 20 microns and not more than 100 microns, saturation magnetization of not less than 30 emu/g and not more than 100 emu/g, a volume resistivity of not less than $10^7$ ohm.cm and not more than $10^{13}$ ohm·cm, and the non-magnetic toner particles have an average particle size of not less than 5 microns and not more than 20 microns and a volume resistivity of not less than $10^{13}$ ohm·cm.

29. An apparatus according to claim 27, wherein the volumetric ratio of the magnetic carrier is not less than 1.5% and not more than 30% in the developing zone.

30. An apparatus according to claim 29, wherein the volumetric ratio is not less than 9% and not more than 26%.

* * * * *

UNITED STATES PATENT AND TRADEMARK OFFICE

CERTIFICATE OF CORRECTION

PATENT NO. : 5,239,343

DATED : August 24, 1993

INVENTOR(S) : SAKEMI ET AL.

It is certified that error appears in the above-identified patent and that said Letters Patent is hereby corrected as shown below:

Column 1

Line 8, change "RELATED" to --RELATED ART--.
Line 55, change "sometimes" to --sometimes in--.

Column 3

Line 12, after "between" insert --it and--.
Line 38, delete "b".

Column 4

Line 21, delete "to function".

Column 5

Line 20, change "unit" to --/unit-- and change "chain" to --chains--.

Column 6

Line 21, change "width 1" to --width l--.
Line 27, change "1" (one) to --l--.
Line 37, change "electric" to --magnetic--.
Line 58, change "sleeve:" to --sleeve: constant--.
Line 66, change "width 1" to --width l--.

UNITED STATES PATENT AND TRADEMARK OFFICE

CERTIFICATE OF CORRECTION

PATENT NO. : 5,239,343

DATED : August 24, 1993

INVENTOR(S) : SAKEMI ET AL.

It is certified that error appears in the above-identified patent and that said Letters Patent is hereby corrected as shown below:

Column 7

Line 12, change "1" to --l--.

Column 8

Line 2, change "as if it" to --as it--.
Line 19, change "polarity," to --polarity--.
Line 20, change "operation" to --operation,--.
Line 40, change "width 1" to --width l--.
Line 43, change "length 1" to --length l--.
Line 49, change "plate" to --blade--.
Line 51, change "plate" to --member--.
Line 60, change "plate" to --blade--.
Line 62, change "plate" (first occurrence) to --blade-- and change "plate" (second occurrence) to --member--.
Line 63, change "plate" to --member--.
Line 66, change "plate" to --blade--.

Column 9

Line 4, change "plate" to --blade--.
Line 5, change "plate" to --member--.
Line 8, change "plate" (first occurrence) to --blade-- and change "plate" (second occurrence) to --member--.
Line 13, change "plate" (first occurrence) to --blade-- and change "plate" (second occurrence) to --member--.
Line 15, change "plate" to --member--.
Line 33, change "plate" to --member--.
Line 52, change "manner" to --manner,--.

UNITED STATES PATENT AND TRADEMARK OFFICE

CERTIFICATE OF CORRECTION

PATENT NO. : 5,239,343

DATED : August 24, 1993

INVENTOR(S) : SAKEMI ET AL.

It is certified that error appears in the above-identified patent and that said Letters Patent is hereby corrected as shown below:

Column 10

Line 14, change "detection" to --direction--.
Line 43, change "detection" to --direction--.
Line 64, change "member: and" to --member; and--.

Column 11

Line 43, change "since it is" to --since if it is--.

Column 12

Line 19, change "decreased" to --lower--.

Column 13

Line 28, change "obtained. (" ","O" and" to --obtained. ("⊙", "O" and--.
Line 65, change "angle θ" to --angle $\theta_3$--.

Column 16

Line 9, before "to" insert --according--.

UNITED STATES PATENT AND TRADEMARK OFFICE

CERTIFICATE OF CORRECTION

PATENT NO. : 5,239,343 Page 4 of 4

DATED : August 24, 1993

INVENTOR(S) : SAKEMI ET AL.

It is certified that error appears in the above-identified patent and that said Letters Patent is hereby corrected as shown below:

Column 19

Line 2, change "the said" to --said--.
Line 9, change "<≦1.5mm," to --≦1.5mm,--.

Column 20

Line 2, change "clearance 31" to --clearance d1--.

Signed and Sealed this

Twenty-eighth Day of June, 1994

*Attest:*

Bruce Lehman

BRUCE LEHMAN

*Attesting Officer*

*Commissioner of Patents and Trademarks*